US010639539B1

(12) United States Patent
Longo

(10) Patent No.: US 10,639,539 B1
(45) Date of Patent: May 5, 2020

(54) GOLF PRACTICE BOARD FOR IMPROVING GOLF SWING

(71) Applicant: Robert Jon Longo, Corona, CA (US)

(72) Inventor: Robert Jon Longo, Corona, CA (US)

( * ) Notice: Subject to any disclaimer, the term of this patent is extended or adjusted under 35 U.S.C. 154(b) by 0 days.

(21) Appl. No.: 16/299,477

(22) Filed: Mar. 12, 2019

Related U.S. Application Data

(60) Provisional application No. 62/645,076, filed on Mar. 19, 2018.

(51) Int. Cl.
*A63B 69/36* (2006.01)
*A63B 102/32* (2015.01)

(52) U.S. Cl.
CPC ..... *A63B 69/3661* (2013.01); *A63B 2102/32* (2015.10); *A63B 2209/00* (2013.01)

(58) Field of Classification Search
CPC ..... A63B 69/3661; A63B 2069/3664
USPC ..... 473/257, 262, 263, 264, 265
See application file for complete search history.

(56) References Cited

U.S. PATENT DOCUMENTS 3,113,780 A * 12/1963 Livingstone ..... A63B 69/3623 473/265
2006/0128493 A1* 6/2006 Snopkowski ..... A63B 69/3661 473/278
2008/0200277 A1* 8/2008 Mitchell ..... A63B 69/3661 473/270
2011/0250391 A1* 10/2011 Dorchester ..... B32B 3/08 428/138
2012/0045605 A1* 2/2012 Collins ..... B32B 5/024 428/52
2018/0016724 A1* 1/2018 Akkad ..... D05C 17/00
2018/0369704 A1* 12/2018 Whitaker ..... A63H 3/003

* cited by examiner

*Primary Examiner* — William M Pierce
(74) *Attorney, Agent, or Firm* — Plager Schack LLP; Mark H. Plager; Kara Verryt

(57) ABSTRACT

A golf practice board to indicate a club head's path along a ground surface to improve a golfer's swing may include a frame with a bottom surface; a mat secured within the frame; and a plurality of multi-colored discs pivotably attached to a top surface of the mat, wherein an obverse surface of the multi-colored discs has a different color than a reverse surface of the multi-colored discs. The board may also include a cushioning material positioned between the frame and the mat.

5 Claims, 5 Drawing Sheets

GOLF PRACTICE BOARD FOR IMPROVING GOLF SWING

RELATED APPLICATION

This application claims priority to provisional patent application U.S. Ser. No. 62/645,076 filed on Mar. 19, 2018, the entire contents of which is herein incorporated by reference.

BACKGROUND

The embodiments herein relate generally to golfing, and more particularly, to a golf practice board for improving a golfer's swing.

The most important part of the golf swing is when the golf club impacts the golf ball. It is the golfer's desire to hit the ball with the center of the golf club's face. This usually involves hitting the ground just before the golf ball, traveling through the golf ball in a straight line to the target, and resulting in a small divot after the golf ball.

Having a resettable practice board that indicates the impact location and path after making contact with the golf ball is beneficial for learning how to hit the golf ball with the golfer's desired results.

U.S. Patent Application Publication No. 2006/0128493 uses artificial grass that flattens to indicate the path of the club, but it can be difficult to distinguish between flattened grass and non-flattened grass quickly and easily.

U.S. Pat. No. 7,448,956 uses an artificial grass blade that has a two colored membrane that clicks over a stiffener, which is supposed to indicate a blade of grass that has contact with the club. However, construction of the artificial grass blades is complex and does not allow the artificial grass blade to bend over, but instead has the membrane click, meaning the that grass blade is always in an upright position. Because of the complex construction, the device is costly to produce.

Therefore, what is needed is a golf practice board that clearly displays the golf club head's impact point and club head path with ground contact, while simultaneously having a simplified structural design as compared to the prior art.

SUMMARY

Some embodiments of the present disclosure include a golf practice board to indicate a club head's path along a ground surface to improve a golfer's swing. The practice board may include a frame with a bottom surface; a mat secured within the frame; and a plurality of multi-colored discs pivotably attached to a top surface of the mat, wherein an obverse surface of the multi-colored discs has a different color than a reverse surface of the multi-colored discs. The board may also include a cushioning material positioned between the frame and the mat.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a golf practice board and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Frame
b. Mat
c. Multi-Colored Discs
d. Anchors

The various elements of the device of the present disclosure may be related in the following exemplary fashion. It is not intended to limit the scope or nature of the relationships between the various elements and the following examples are presented as illustrative examples only.

Figure 1:
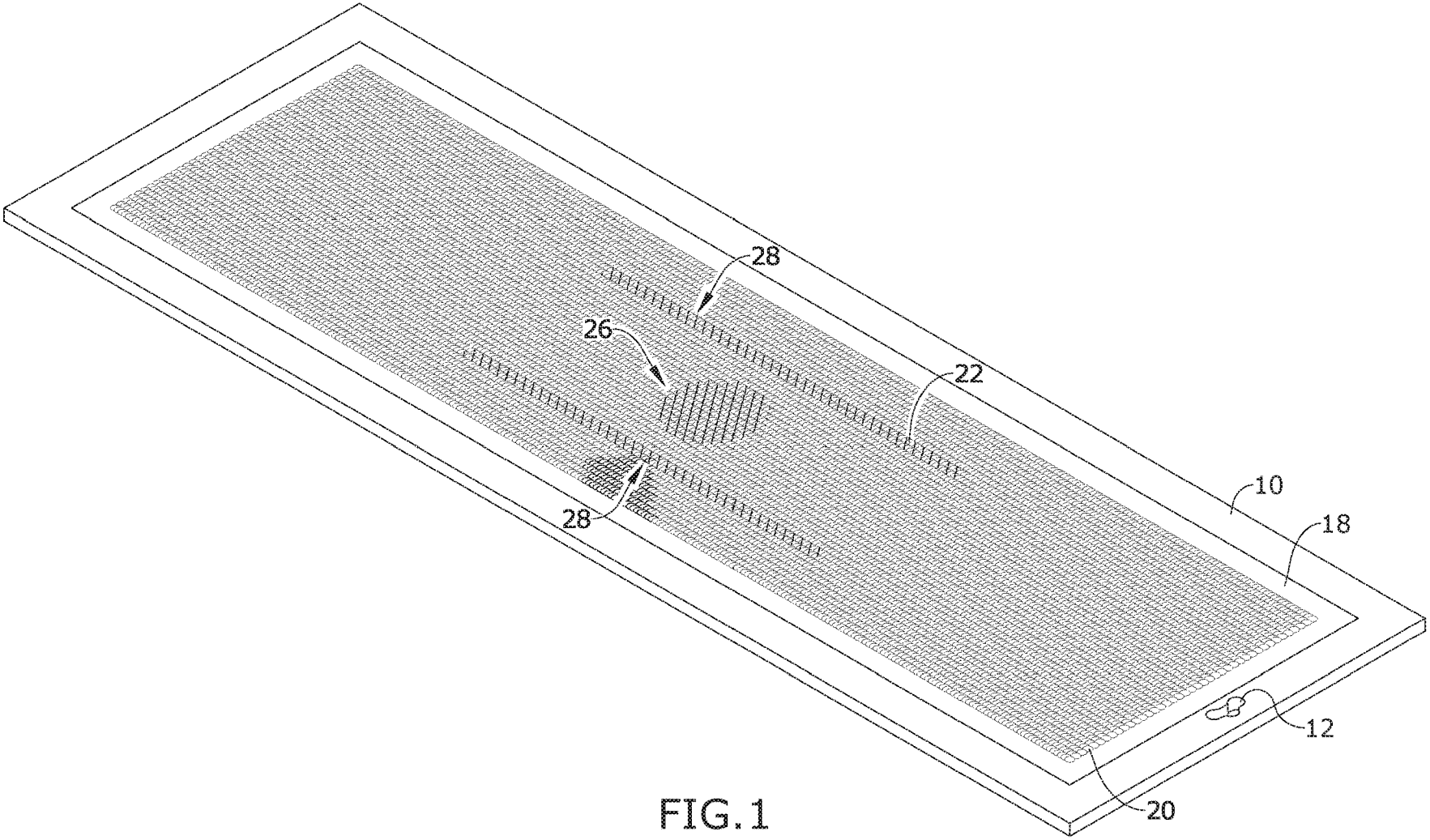
FIG. 1 is a top perspective view of one embodiment of the present disclosure.
Figure 2:
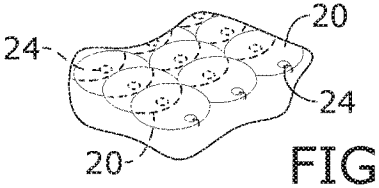
FIG. 2 is a detail perspective view of one embodiment of the present disclosure.
Figure 3:
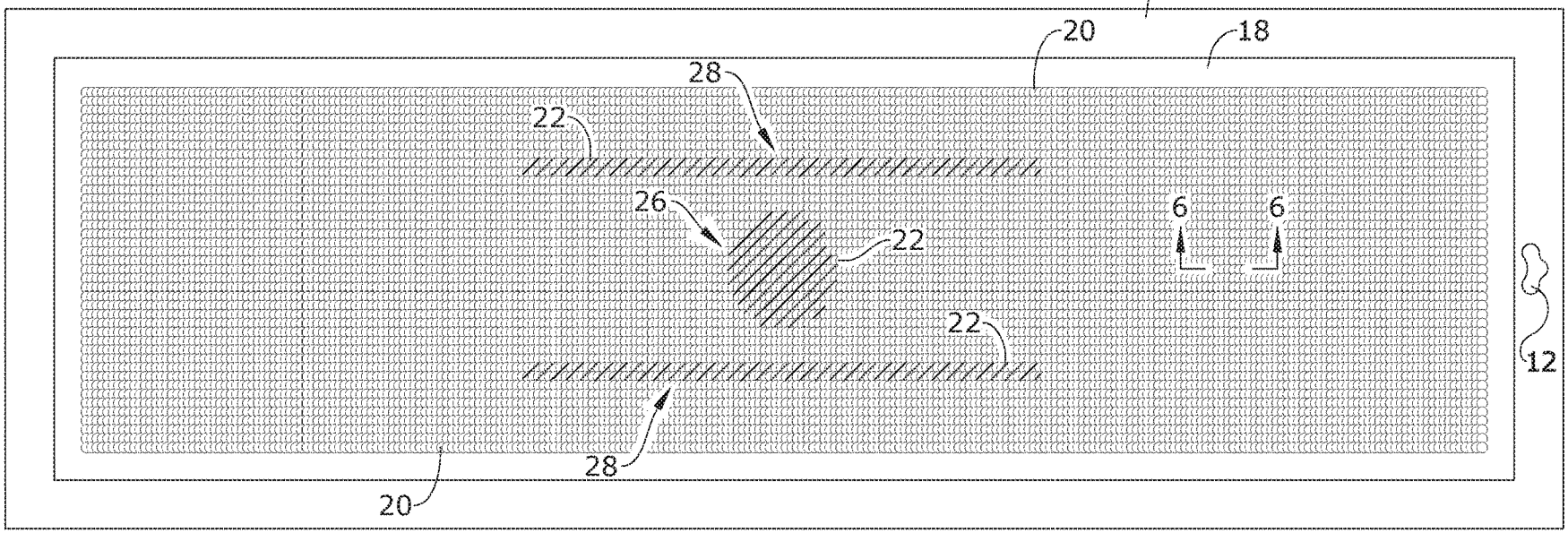
FIG. 3 is a top view of one embodiment of the present disclosure.
Figure 4:
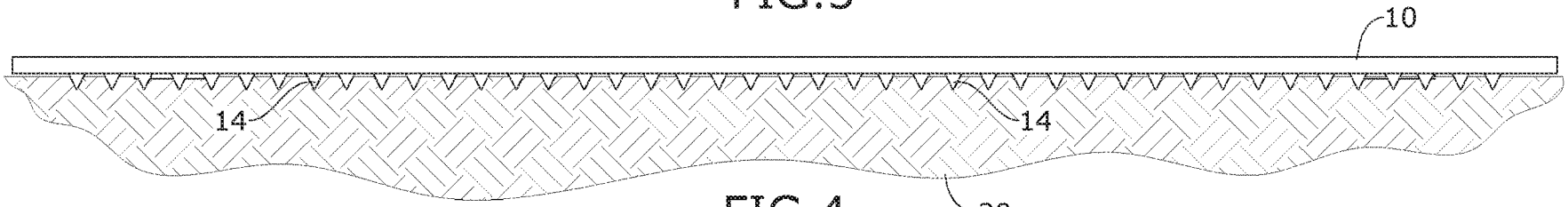
FIG. 4 is a side view of one embodiment of the present disclosure.
Figure 5:
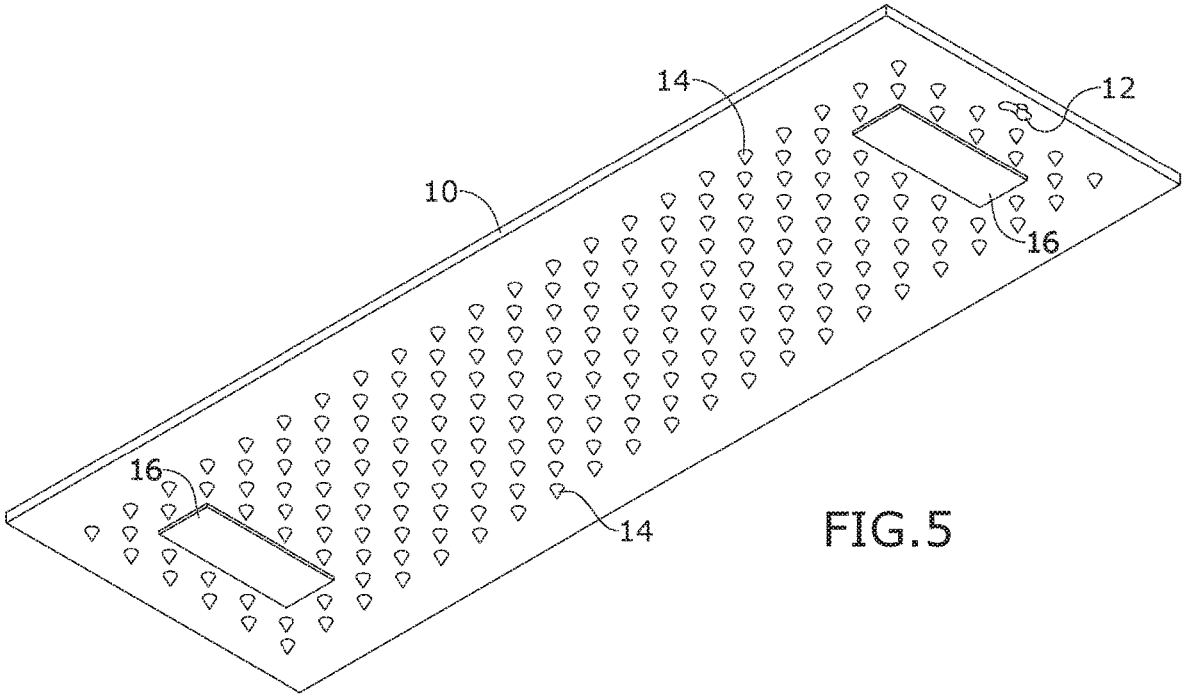
FIG. 5 is a bottom perspective view of one embodiment of the present disclosure.
Figure 6:
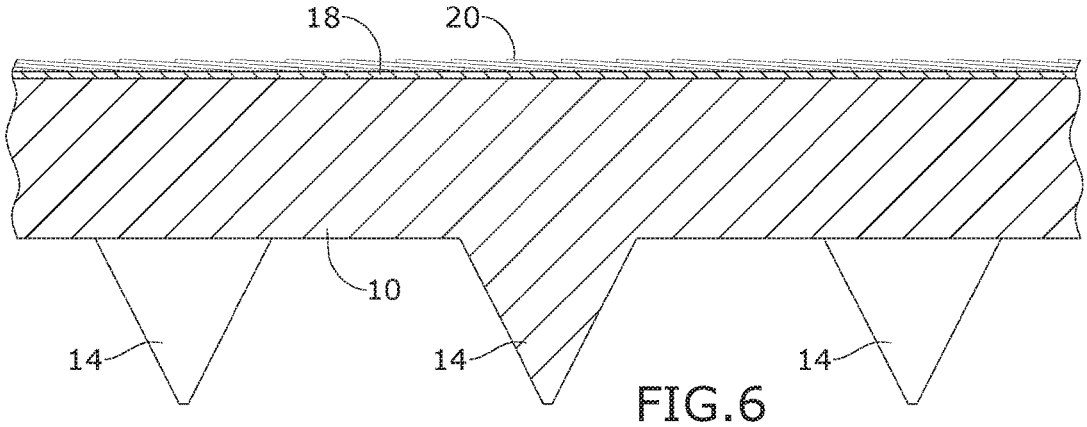
FIG. 6 is a section view of one embodiment of the present disclosure, taken along line 6-6 in FIG. 3.
Figure 7:
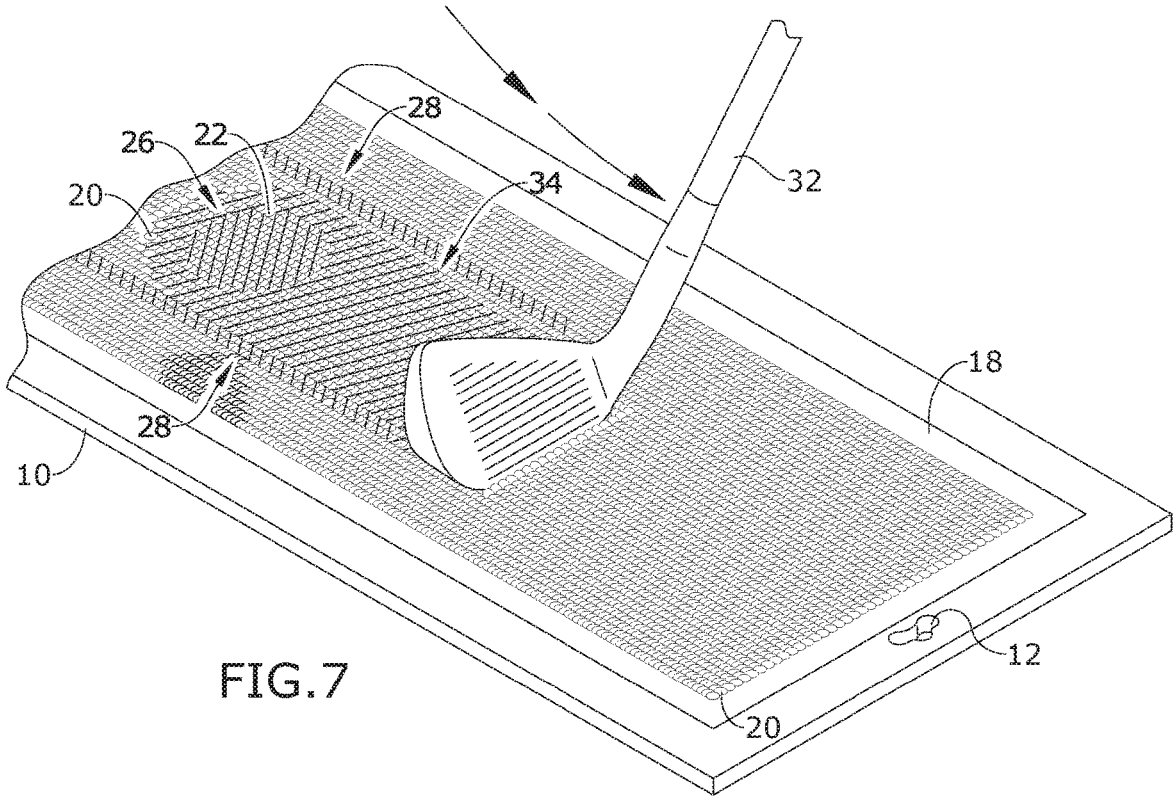
FIG. 7 is a perspective view of one embodiment of the present disclosure.
Figure 8:
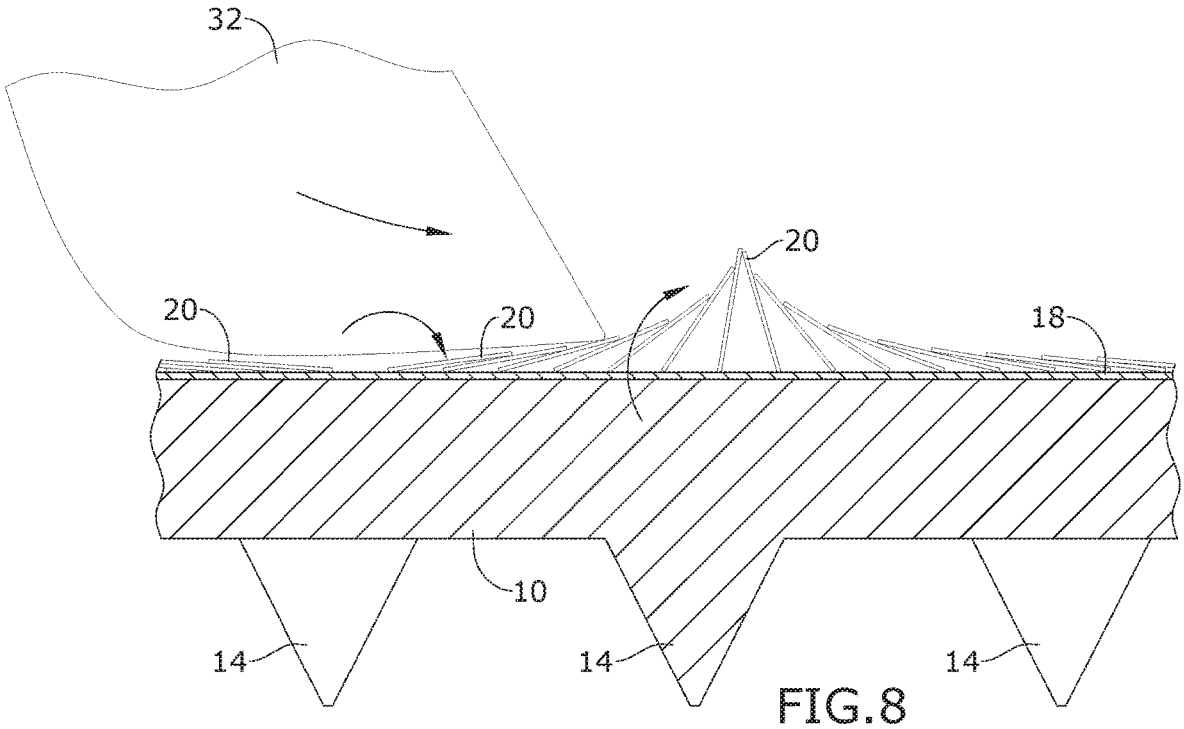
FIG. 8 is a detail section view of one embodiment of the present disclosure.
Figure 9:
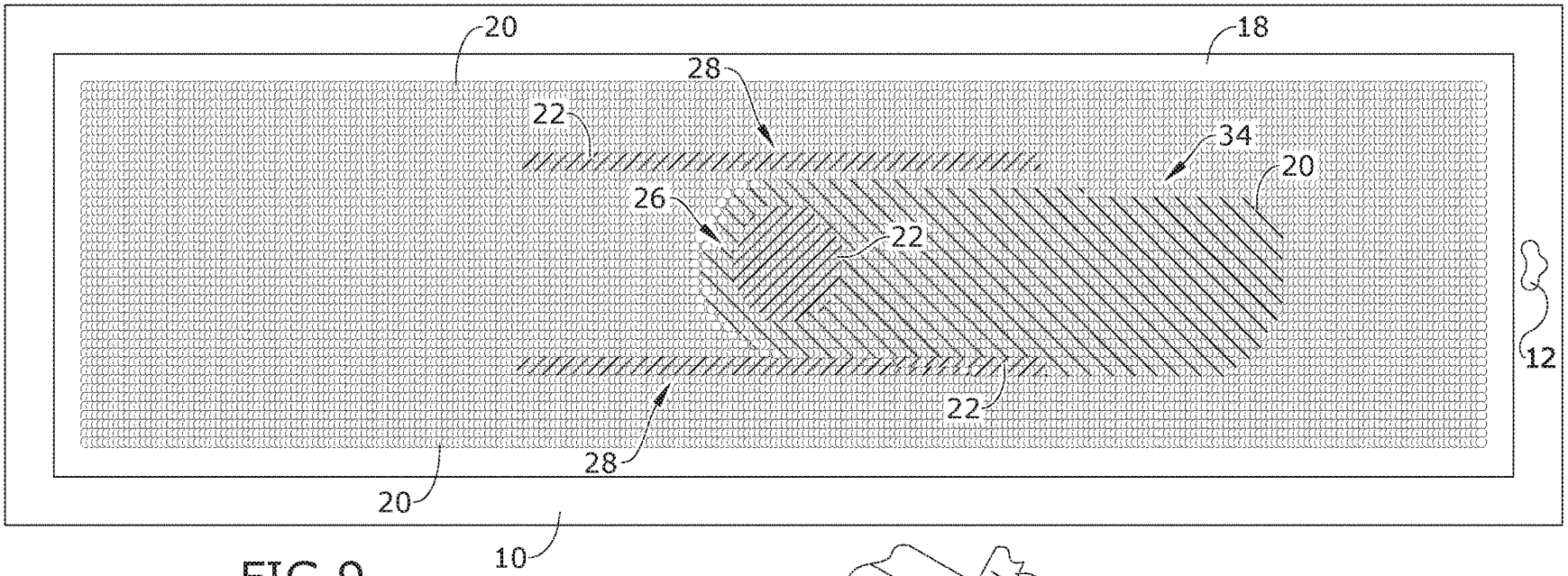
FIG. 9 is a top view of one embodiment of the present disclosure.
Figure 10:
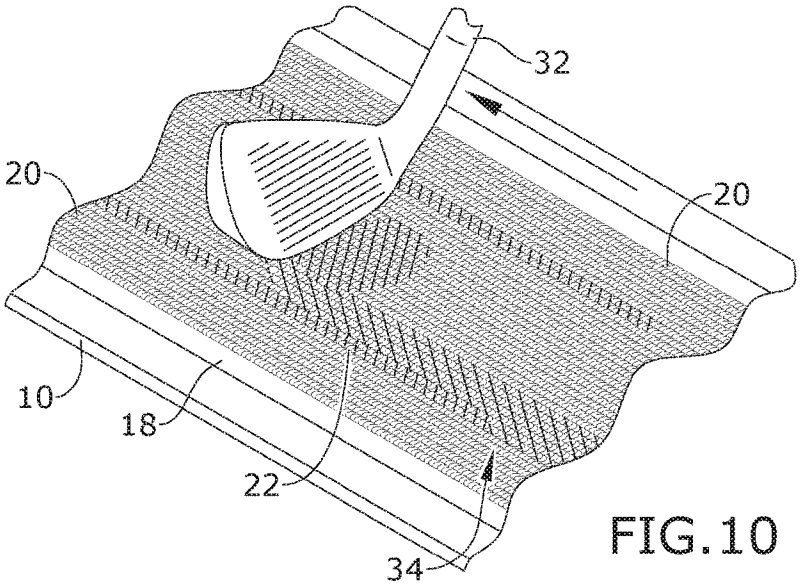
FIG. 10 is a perspective view of one embodiment of the present disclosure.

By way of example, and referring to FIGS. 1-10, some embodiments of the present disclosure include a golf practice board to indicate a club head's path along the ground to improve a golfer's swing, the golf practice board comprising a frame 10 with a bottom surface; a mat 18 held within the frame 10, the mat 18 comprising a plurality of multi-colored discs 20 attached thereto, wherein an obverse surface of the multi-colored discs 20 has a different color than a reverse surface of the discs 20; and a plurality of anchors attached to the bottom surface of the frame 10, the anchors designed to help secure the practice board to a ground surface. While not shown in the Figures, some embodiments of the practice board also comprise a cushioning material, such as a foam layer, held within the frame and vertically below the mat 18.

The mat 18 may comprise a material layer, such as an impact resistant material layer, to which the multi-colored discs 20 are attached. In embodiments, the multi-colored discs 20 may be attached to the material layer using any fastening mechanism that will allow the multi-colored discs 20 to pivot from a first orientation (showing the color on the obverse surface of the multi-colored discs 20) to a second orientation (showing the color on the reverse surface of the multi-colored discs 20) when an object, such as a golf club 32, is pulled along the surface of the practice board. For example, the multi-colored discs 20 may be sewn to the material layer using an impact resistant thread. The obverse and reverse surfaces of the multi-colored discs 20 may have any desired colors, so long as the colors are distinguishable from one another. For example, the obverse surface may be green, while the reverse surface may be brown. As such, when a golfer practices swinging over the board, the multi-colored discs 20 may flip from the first orientation to the second orientation producing a divot pattern 34 showing a visual representation of the path that the golf club 32 took along the practice board. The board may then be reset so that all multi-colored discs 20 show the same color by simply swiping the user's hand, the golf club 34, or the like back over the surface of the board. Thus, the board may be used repeatedly.

In embodiments, the mat 18 may be attached or secured to the frame 10 using any suitable fastener. In some embodiments, the mat 18 is removably secured to the frame 10 such that it is replaceable. In such instances, the mat 18 may be attached to the frame 10 using a fastener such as double sided tape, hook and loop fastener, snaps, or the like.

In some embodiments, the mat 18 may also comprise a plurality of single colored discs 22 arranged within the multi-colored discs 20 to provide desired markings that may further help a golfer improve his or her swing. Unlike the multi-colored discs 20, the sing colored discs 22 may be the same color on both the obverse and reverse surfaces thereof. For example, as shown in the Figures, the single colored discs 22 may be arranged on the mat to provide a pair of parallel side stripe patterns 28 and a centrally located center ball marker pattern 26. Of course, the use of other patterns are envisioned. The side stripe patterns 28 may function to indicate the desired location on the board for the golf club 32 to make impact, while the center ball marker pattern 26 may allow a golfer to use the practice board with or without an actual golf ball.

As mentioned above, a bottom surface of the frame 10 may include anchors attached thereto. As shown in, for example, FIG. 5, the anchors may comprise a plurality of mounting spikes 14 extending outwardly from the bottom surface of the frame 10. In embodiments, these mounting spikes 14 may be integrated into the construction of the frame 10. Alternatively, other suitable anchors, such as golf cleats, may be attached to the bottom surface of the frame 10. In fact, any anchors suitable for anchoring the board to a carpet, grass, or other ground surface may be used.

In embodiments, the practice board may also include a plurality of optional features. For example, the frame 10 may include a hanger orifice 12 extending therethrough, wherein the hanger orifice 12 may be used to hang the practice board on a vertical surface for storage purposes. Additionally, the frame 10 may include at least one logo display area 16 such that the board may include any desired logo applied thereto. For example, while not limited to this particular location, the logo display area 16 may be positioned on a bottom surface of the frame 10.

The practice board of the present disclosure may have any desired shape and size and, in some embodiments, may be substantially rectangular shaped. The practice board may have a height, such as about ¼ inch, that does not require the golfer's feet to be elevated for use. While any desired size is envisions, a particular embodiment of the practice board may be about 30 inches long and about 10 inches wide, wherein the frame comprises an impact resistant material, such as impact resistant plastic. However, the use of any desired materials is envisioned.

To use the practice board of the present disclosure, the user may either place a ball onto the board or simply use the center ball marker pattern 26 on the board as a reference. The user may then practice his or her swing. When the golf club 32 contacts the multi-colored discs 20, the multi-colored discs 20 may pivot, showing a different color, such that the user has a visual indication of the path the golf club 32 took. Because of the construction of the board, repeated use may not damage the board, and the board may be able to withstand swings up to at least 120 mph.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A golf practice board to indicate a club head's path along a ground surface to improve a golfer's swing, the golf practice board comprising:

a mat;

a plurality of multi-colored discs pivotably attached to a top surface of the mat, such that when an object passes over the plurality of multi-colored discs, the plurality of multi-colored discs pivot from a first orientation showing an obverse surface of the multi-colored discs to a second orientation showing a reverse surface of the multi-colored discs;

a frame with a bottom surface, wherein the mat is secured within the frame; and a plurality of anchors attached to the bottom surface of the frame, wherein:

the obverse surface of the multi-colored discs has a different color than the reverse surface of the multi-colored discs; and the plurality of anchors comprise a plurality of mounting spikes.

2. The golf practice board of claim 1, further comprising a hanging orifice extending through the frame.

3. The golf practice board of claim 1, further comprising a plurality of single colored discs arranged on the mat within the multi-colored discs, wherein:

the plurality of single colored discs are arranged to form patterns on the mat; and an obverse surface of the single colored discs is the same color as a reverse surface of the single colored discs.

4. The golf practice board of claim 3, wherein the plurality of single colored discs form a pair of parallel side stripe patterns.

5. The golf practice board of claim 3, wherein the plurality of single colored discs form a center ball marker pattern.

* * * * *